United States Patent [19]

Churchman

[11] 4,291,722

[45] Sep. 29, 1981

[54] DRILL STRING SAFETY AND KILL VALVE

[75] Inventor: Ronald K. Churchman, Carrollton, Tex.

[73] Assignee: Otis Engineering Corporation, Dallas, Tex.

[21] Appl. No.: 91,086

[22] Filed: Nov. 5, 1979

[51] Int. Cl.[3] ..... E21B 41/00

[52] U.S. Cl. ..... 137/496; 137/614.19; 166/322; 166/323; 166/325; 175/242

[58] Field of Search ..... 251/58, 62, 63.6; 166/321, 322, 324, 318, 319, 325, 332, 334; 137/496, 614.2, 614.19; 175/242

[56] References Cited

U.S. PATENT DOCUMENTS

| | | | |
|---|---|---|---|
| 2,848,053 | 8/1958 | Curry | 166/325 |
| 3,126,908 | 3/1964 | Dickens | 166/323 |
| 3,200,837 | 8/1965 | Brown | 137/496 |
| 3,886,967 | 6/1975 | Nelson | 166/322 |
| 3,955,624 | 5/1976 | Fredd et al. | 166/322 |
| 3,967,647 | 7/1976 | Young | 251/58 |
| 4,009,753 | 3/1977 | McGill et al. | 251/58 |
| 4,026,362 | 5/1977 | Mott | 251/62 |
| 4,074,761 | 2/1978 | Mott | 137/496 |
| 4,220,176 | 9/1980 | Russell | 137/496 |

*Primary Examiner*—Martin P. Schwadron
*Assistant Examiner*—A. Michael Chambers
*Attorney, Agent, or Firm*—H. Mathews Garland

[57] ABSTRACT

A drill string safety and kill valve for a string of drill pipe used for drilling wells including a tubular valve body connectible in the drill pipe, a ball valve in the body mounted to rotate between open and closed positions for controlling flow through the body, a longitudinally movable tubular ball valve operator in the body connected with the ball valve, a spring biased flapper valve in the ball valve operator mounted to permit downward flow and to close responsive to upward flow for raising the ball valve operator to close the ball valve, a side port provided in the side of the ball valve positioned upwardly when the ball valve is closed for pumping drilling fluids downwardly into the bore of the closed ball valve, and a spring biased lower ball valve seat moved downwardly by downward flow of drilling fluid when the ball valve is closed to allow pumping into a well for killing the well after valve closure. During normal drilling operations drilling fluids are pumped downwardly through the open flapper and ball valves. A sudden upward pressure surge closes the flapper valve which in turn closes the ball valve. Heavier drilling fluid for killing the well may then be pumped downwardly through the flapper valve into and around the closed ball valve pushing the lower ball valve seat downwardly away from the ball valve and downwardly between the ball valve and lower seat to enter the formation being drilled.

17 Claims, 9 Drawing Figures

DRILL STRING SAFETY AND KILL VALVE

This invention relates to well tools and more particularly relates to a drill string safety valve functioning to check sudden upward flow and allow subsequent downward flow to kill a well.

Oil and gas wells are drilled with a drill bit supported on the lower end of a string of drill pipe connected with a kelly suspended from a swivel supported from a traveling block which is raised and lowered as the drill string is manipulated in the well bore. The swivel and kelly are connected with a hose through which drilling fluid is pumped. The drilling fluid flows downwardly through the kelly and drill pipe and outwardly through the drill bit to wash cuttings from the well bore upwardly around the drill bit and drill string and to maintain a pressure on the formations being drilled to prevent the well blowing out upwardly through the bore around the bit and drill string. Since there is a continuous flow passage through the kelly, drill string, and bit from the surface to the formation being drilled, an unexpected high pressure which is greater than the hydrostatic pressure of the drilling fluid may blow the drilling fluid upwardly through the drill string causing a well blowout which can create a dangerous and destructive fire along with resulting in the loss of valuable petroleum oil and gas. One proposed device for temporarily closing the flow passage through a drill string in the event of an emergency which might cause a well blowout is a drill string check valve as shown in U.S. Pat. No. 3,200,837 issued Aug. 7, 1965 to Norman F. Brown, assigned to Otis Engineering Corporation. The Brown check valve is pressure responsive closing when the pressure around the valve exceeds the pressure within the flow passage through the valve causing a piston operator within the valve housing to move upwardly closing the valve. The structure of the Brown valve presents several possible operational problems which are solved by the present invention. In the Brown device since it is pressure responsive at a location in the vicinity of the ball valve under circumstances where the drill string is being lowered in a well bore using a closely fitting drill bit which might cause a pressure drop across the drill bit to the annulus around the valve body above the drill bit could create a lower pressure condition at the valve body which would preclude immediate closing of the check valve even though a surge of high pressure occurred from below the drill bit upwardly through the bore of the check valve. Under similar circumstances the structure of the present valve causes the valve to close. Additionally, after the Brown valve is closed the only way the drilling fluid can be pumped through the drill string to the formation through the valve is by reopening the valve. In contrast in the present invention the valve structure permits the ball valve member to remain closed while drilling fluid may be pumped through the drill string around the ball valve member to kill the well with any upward pressure surge causing immediate reaction of the valve to prevent upward flow through the valve at a more rapid rate than possible with the Brown valve.

It is an especially important object of the present invention to provide a new and improved safety valve for drill pipe.

It is another object of the invention to provide a safety and kill valve for drill pipe which remains substantially closed while the drill bit and drill pipe are lowered in a well bore providing an additional measure of safety while running the drill string into the well bore.

It is another object of the invention to provide a drill string safety valve which has a normally closed flapper valve in a ball valve operator providing very quick closure in the event of a pressure surge into the drill string from below the valve.

It is another object of the invention to provide a drill string safety valve which may be pumped through to kill a well without reopening the ball valve of the device.

It is another object of the invention to provide a drill string safety valve which remains closed after closing in response to a pressure surge and may be reopened mechanically.

It is another object of the invention to provide a drill string safety valve which utilizes a flapper type valve in a ball valve actuator providing a velocity responsive safety valve.

In accordance with the invention there is provided a drill string safety kill valve which includes a tubular body connectible in a string of drill pipe, a ball valve rotatably supported in the body for movement between open and closed positions, a tubular ball valve operator coupled with the ball valve for opening and closing the ball valve, a flapper valve having a port therethrough mounted in the valve operator for partially shutting off flow through the valve operator, a side port provided in the ball valve leading to the bore through the ball valve and positioned upwardly when the ball valve is closed, and a spring biased lower ball valve seat adapted to move downwardly to permit fluid flow around the ball valve when the ball valve is closed.

The foregoing objects and advantages of the invention will be better understood from the following detailed description thereof taken in conjunction with the accompanying drawings wherein:

FIG. 1 is a fragmentary schematic view partially in section illustrating the safety and kill valve of the invention connected in a drill string being used to drill a well bore in an earth formation;

FIGS. 2A and 2B taken together form a longitudinal view partially broken away in section and elevation of a preferred embodiment of the valve of the invention;

Figure 1:
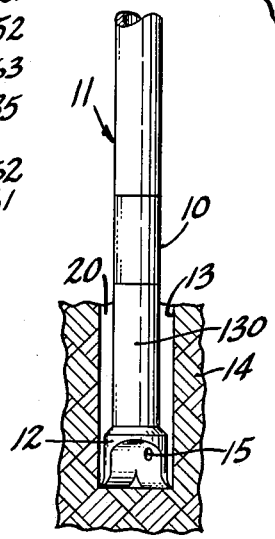

Referring to FIG. 1, a drill string safety and kill valve 10 embodying the features of the invention is included as an integral part of a string of drilling pipe 11 employed to turn a drill bit 12 on the lower end of the string for drilling a well bore 13 in an earth formation 14 for the purpose of drilling a well such as an oil or gas well. During the drilling of the well bore 13 drilling fluid is normally pumped down through the bore of the drill pipe and outwardly through one or more holes 15 in the drill bit into the annulus 20 defined between the drill string and the wall of the well bore. The drilling fluid flows upwardly to the surface through the annulus carrying the cuttings thereby cleaning the well bore as drilled. Additionally, an extremely important function provided by the drilling fluid is to apply a hydrostatic pressure along the earth formation being drilled. Ideally the hydrostatic pressure is at least as great or greater than the pressure of the formation fluids to prevent a well blowout which can be disasterous both from the standpoint of physical damage and injury but also the loss of valuable fluids such as petroleum oil and gas. The valve 10 of the invention forms an integral member of the drill string permitting drilling fluid flow through the drill string while providing a safety valve function in the bore of the drill string to shut off flow upwardly through the drill string in the event of an unexpected pressure surge.

Figure 2A:
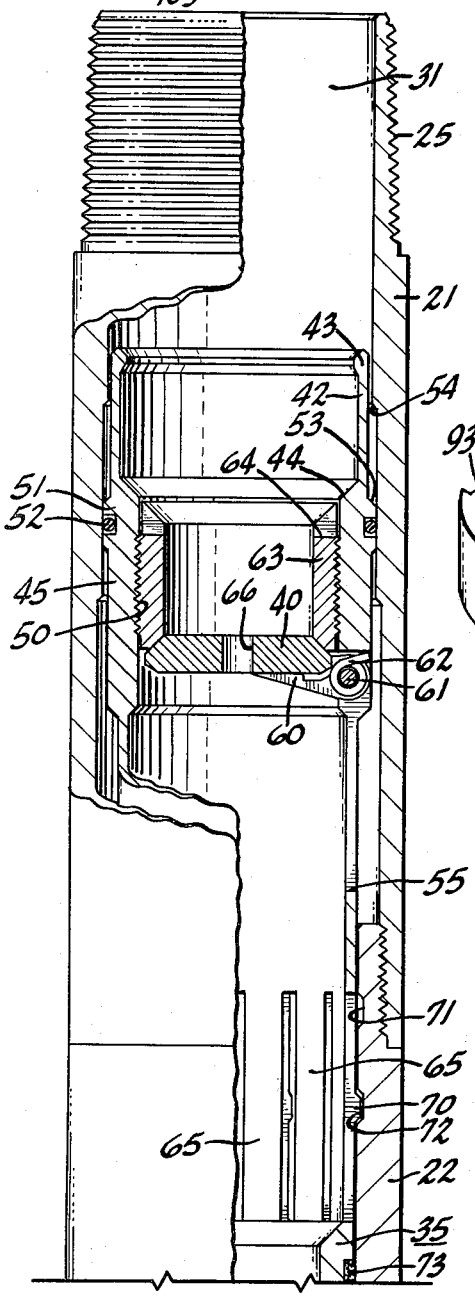
Figure 2B:
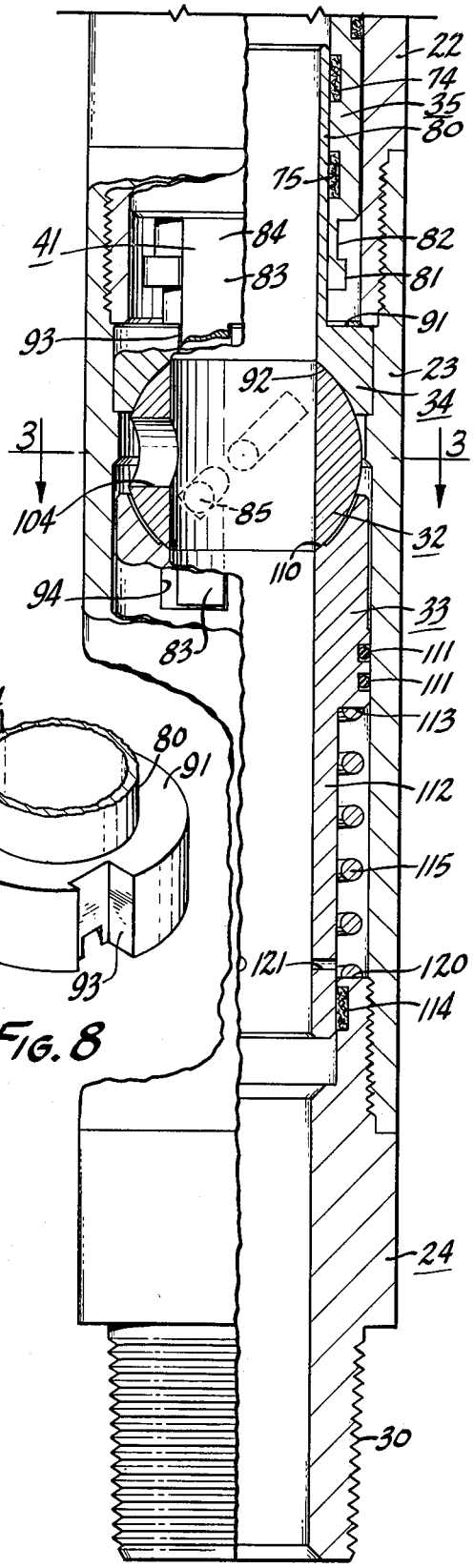

Referring to FIGS. 2A and 2B, the drill string safety kill valve has a tubular body formed by an upper tubular section 21, intermediate sections 22 and 23, and a lower end section 24. The upper section 21 is externally threaded at 25 for connection of the upper end of the valve body into the drill string. Similarly the lower end body section 24 is externally threaded at 30 for connecting the portions of the drill string below the valve to the valve body. The upper end of the section 22 is threaded into the lower end of the section 21 and into the upper end of the section 23. The section 23 threads along a lower end portion to the upper end portion of the section 24. The valve body has a longitudinal bore 31 extending throughout the length of the body and of substantially the same diameter as the drill pipe with which the body is connected for allowing flow of the drilling fluids in the drill string through the valve.

As shown in FIGS. 2A and 2B the flow control structure of the valve 10 comprises a ball valve 32 rotatably mounted between a lower valve seat 33 and an upper valve seat 34, a tubular valve operator 35 having a flapper valve 40 and a pair of ball valve operator arms 41 coupling the valve operator with the ball valve.

Referring to FIGS. 2A and 2B, the tubular valve operator 35 has an upper end fishing neck portion 42 provided with an internal annular flange 43 and an upwardly facing sloping stop shoulder 44. Below the fishing neck portion the valve operator has a section 45 which is of increased wall thickness being provided internally with a threaded section 50 and externally with a flange 51 having an external annular recess in which a ring seal 52 is disposed for sealing around the operator with the inner wall of the body section 21. The upper end of the flange portion 51 defines an annular stop shoulder 53 on the operator which is engageable with an internal annular downwardly facing stop shoulder 54 within the valve body section 21 to limit the upward movement of the valve operator 35 to the upper end position shown in FIG. 6. A longitudinal window 55 is formed in the operator 35 as shown in FIG. 2A extending into the lower end portion of the section 45 of the operator for the flapper valve 40. The flapper valve 40 is mounted on an arm 60 pivoted on a pin 61 mounted transversely in the operator 35 across the window 55. A spring 62 is wound around the pin 61 with one end engaging the lower face of the flapper valve 40 and the other end engaging a downwardly facing upper end of the window 55 thereby biasing the flapper valve clockwise toward the closed position shown in FIG. 2A. An externally threaded tubular flapper valve seat 63 is engaged with the threads 50 in the valve operator section 45 providing a downwardly facing seat for engagement by the flapper valve. The seat 63 has diametrically opposed upwardly facing slots 64 to permit a spanner wrench to engage the seat for installing the seat in the upper end of the tubular valve operator. The central portion of the tubular valve operator below the window 55 is longitudinally slotted defining a plurality of circumferentially spaced collet fingers 65 each of which has an external locking boss or detents 70. The detents 70 on the fingers 65 are engageable with longitudinally spaced upper and lower internal annular locking recesses 71 and 72 in the valve housing section 22 for releasably locking the valve operator 35 at positions at which the ball valve 32 is open as in FIGS. 2A and 2B and closed as in FIG. 6.

The flapper valve 40 has a central port or opening 66 which is large enough to allow the drill string to be lowered in a drilling fluid filled well bore and small enough to induce enough pressure differential to operate the valve operator 35.

As shown in FIGS. 2A and 2B, below the collet fingers 65 the valve operator 35 has a section of increased wall thickness having an external annular recess and two longitudinally spaced internal annular recesses for holding annular wipers 73, 74, and 75 respectively. The wiper 73 forms a sliding trash barrier between the outer wall of the lower end portion of the ball valve operator 35 and the inner wall surface of the valve body section 22. The wipers 74 and 75 provide a trash barrier between the inner wall of the ball valve operator and a reduced sleeve portion 80 of the upper ball valve seat 34. The ball valve operator 35 has a reduced lower end section as best seen in FIG. 4 provided with an external annular end flange 81 and an external annular recess 82 for coupling the ball valve operating arms 41 with the ball valve operator.

Figure 4:
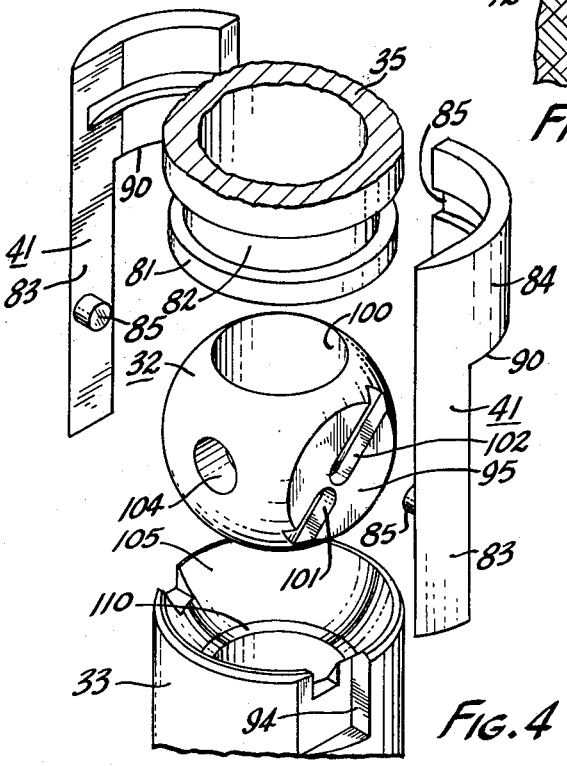
FIG. 4 is a fragmentary exploded perspective view illustrating the ball valve member, lower seat, the lower end of the ball valve operator, and the ball valve operator arms coupling the ball valve member with the operator.

Referring particularly to FIG. 4, the ball valve operator arms 41 each is an integral inverted L-shaped member having a longitudinal arm 83 and a flanged head 84. Each of the arms 83 has an internal ball valve operator pin 85 which is engageable with the ball valve 32 for rotating the ball valve between open and closed positions as the arms 83 reciprocate vertically within the valve body. Each of the arms 83 has a flat inside surface which slides along flats on opposite sides of the ball valve. The head 84 of each of the operator arms is an arcuate cylindrical portion having an internal recess 85 sized to receive the external end flange 81 from the lower end of the valve operator 35 for operatively coupling the valve operator with the heads of the operator arms. The internal portion of the head 84 on each of the operator arms above the recess 85 fits into the external recess 82 on the lower end portion of the valve operator 35. The lower end edge 90 on each of the valve operator heads 84 is engageable with the flat top surface 91 on the upper ball valve seat 34 for limiting downward movement of the assembly of the valve operator 35 and the operator arms 41 when the assembly is moved downwardly returning the ball valve 32 to open position as shown in FIG. 2B.

Figure 6:
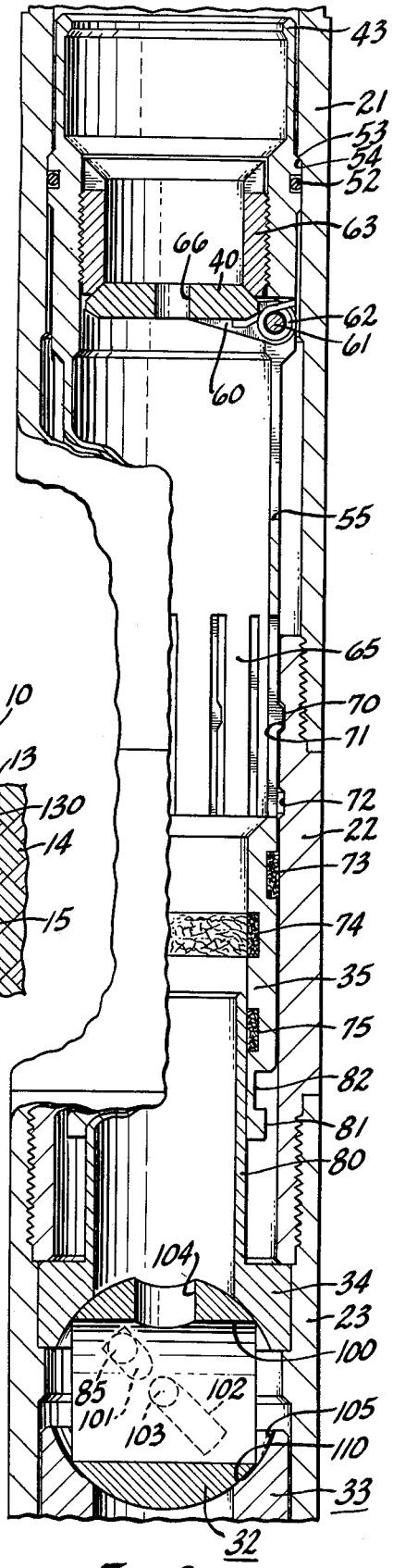
FIG. 6 is a fragmentary longitudinal view in section, partially broken away, of the valve of the invention illustrated fully closed.
Figure 8:
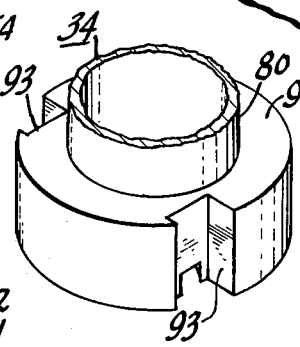
FIG. 8 is a fragmentary view in perspective of the upper ball valve seat illustrating particularly the vertical slots along which the ball valve operator arms pass the upper seat.

Referring to FIGS. 2B, 4 and 8, the upper valve seat 34 has a seat surface 92 engageable by the ball valve 32 in a nonsealing relationship. The seal with the ball valve when the ball valve is closed as in FIG. 6 is effected by the lower valve seat 33. The upper valve seat 34 has vertical slots 93 as best illustrated in FIG. 8 which are positioned around the upper valve seat to permit passage of the two ball valve operator arms 83. Similarly the lower ball valve seat 33 has upwardly opening slots 94 which receive the lower ends of the valve operator arms 83. Both the slots 93 in the upper valve seat and the slots 94 in the lower valve seat for the arms 83 are sufficiently larger than the cross section of the arms to allow the arms to freely slide upwardly and downwardly as the arms rotate the ball valve 32.

Figure 3:
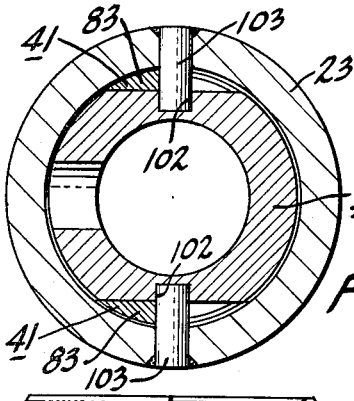
FIG. 3 is a side view in section along the lines 3—3 of FIG. 2B showing the ball valve member open.

Referring to FIG. 4, the ball valve 32 has opposite flat side surfaces 95 which are formed parallel to each other along opposite sides of the ball in planes which are parallel with the axis of the bore 100 through the ball valve 32. Each of the flat side faces 95 of the ball valve is provided with an operating recess 101 and a mounting recess 102. The recesses 101 and 102 are formed along a diameter of the flat ball side surface extending inwardly from opposite sides of the ball side surface terminating in spaced relation with the mounting recess 102 having an end portion which is semi-circular and oriented around the rotational axis of the ball valve as better appreciated from FIG. 2B and FIG. 6. A pair of mounting pins 103 are welded through the valve body section 23 aligned with each other on opposite sides of the body section as shown in FIG. 3 for rotatably mounting the ball valve within the valve body. The outer ends of the pins are flush with the outer wall surface of the body section while the pins project inwardly into the bore of the body section sufficiently to engage the mounting recesses 102 of the ball valve. The inward end portions of the mounting pins occupy the inward ends of the mounting recesses 102 in the ball valve so that the pins are along the axis of rotation of the ball valve permitting the ball valve to rotate about the pins between open and closed positions. The outward ends of the mounting slots 102 are open making it possible to assemble the ball valve in the valve body with the mounting pins 103 welded in place. The operating pins 85 along the inside of each of the ball valve operator arms 83 fit within the operating recesses 101 of the ball valve so that the pins 85 are spaced from the axis of rotation of the ball valve causing the ball valve to be rotated about the pins 103 when the operator arms 83 are raised and lowered by the valve operator 35. The recesses 101 have open outer ends to permit entry of the pins 85 during assembly of the arms with the ball valve.

The ball valve 32 has a bypass side port 104 positioned in the side of the ball valve which is up when the ball valve is closed as in FIG. 6 so that drilling fluids may be pumped downwardly through the port into the bore 100 of the ball valve when the ball valve is closed. The bypass port 104 is formed on an axis, not shown, which is perpendicular to the axis of the bore 100 of the ball valve.

The lower ball valve seat 33 has a spherical internal annular upper end surface 105 including a slightly raised inner annular seal surface 110 which forms a fluid tight seal with the lower face of the ball valve when the ball valve is closed as in FIG. 6. External annular ring seals 111 are positioned in spaced external annular recesses around the upper end portion of the lower ball valve seat 33 to form a sliding seal between the seat and the inner wall surface of the valve body section 23. Below the seals 111 the lower ball valve seat 33 is reduced in external diameter along a lower section 112 providing a downwardly facing external annular stop shoulder 113. The lower end portion of the section 112 of the lower ball valve seat telescopes into the bore of the upper end portion of the body section 24. A wiper 114 is in an internal annular recess within the upper end portion of the body section 24 between the lower end portion of the lower ball valve seat 33 and the body section allowing the lower ball valve seat to move upwardly and downwardly in protected relationship with the body section 24. A spring 115 is confined within the body section 24 around the portion 112 of the lower ball valve seat engaged between the downwardly facing stop shoulder 113 on the lower valve seat and surface 120 on the body section 24. The spring 115 is sufficiently compressed to bias the lower ball valve seat 33 upwardly against the ball valve 32. The lower ball valve seat section 112 has side ports 121 communicating the bore of the ball valve seat with the annular space between the section 112 and the valve body section 22 so that drilling fluid is not trapped within the annulus interfering with the vertical movement of the lower ball valve seat. The ball valve seat must be free to move upwardly and downwardly for pumping drilling fluid past the ball valve. The difference in the diameters of the line of sealing between the seat 110 in the ball valve and the ring seals 111 and the bore of the body section 23 provides an upwardly facing annular area of the lower valve seat 33 which permits drilling fluid to force the lower valve seat downwardly during operation of the device as explained in further detail hereinafter.

In operation the drill string safety and kill valve 10 is connected as shown in FIG. 1 into the drill string as an integral part of the string located immediately above drill collars 130 which are tubular pipe members providing a fluid coupling to the drill bit and weight to the drill string. The valve 10 particularly provides protection during periods when drill pipe connections are being made after having started drilling the bore hole and during times when the pipe string is being run into and pulled from the bore hole. At these times the kelly is removed so that the well is particularly vulnerable to blowout because the upper end of the drill string is then open. With the valve 10 connected in the drill string the drill string is run into the bore hole for drilling the bore hole in the usual manner. The valve is connected into the drill string in the condition illustrated in FIGS. 2A and 2B. The ball valve 32 is open with the ball valve operator 35 at the lower position at which the detents 70 on the collet fingers 65 engage the lower locking recess 72 within the valve body section 22 releasably holding the ball valve open in the position shown in FIG. 2B. The lower ball valve seat 33 is biased upwardly against the ball valve by the spring 115. The flapper valve 40 is at the normal closed position against the lower end of the flapper valve seat 63.

With the drill string safety and kill valve 10 connected into the drill string 11 as described, the drill string is lowered into the bore hole which normally is filled with drilling fluid. The drilling fluid passes upwardly through the bore 31 of the valve passing the closed flapper valve 40 through the central bypass port 66 so that the drill string may be readily lowered in the drilling fluid bore hole even though the flapper valve is closed. The drill string is lowered to the bottom of the bore hole to continue drilling.

Figure 5:
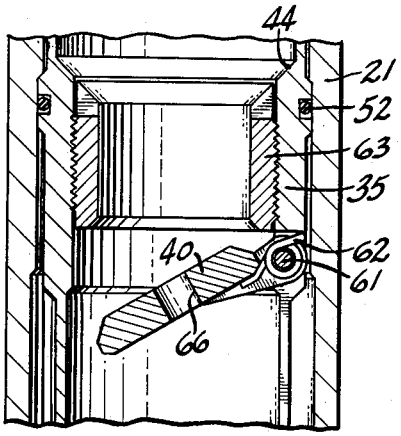
FIG. 5 is a fragmentary view in section showing the flapper valve in the ball valve operator partially open.

As drilling continues drilling fluid is pumped down the drill string through the safety and kill valve 10. The downwardly flowing drilling fluids produce sufficient pressure across the flapper valve 40 that the flapper valve is forced downwardly pivoting on the pin 61 opening the valve to a position such as FIG. 5 dependent upon the drilling fluid velocity and strength of the spring 62. It will be apparent that the flapper valve may swing fully open into the window 55 in the side of the ball valve operator 35. During the pumping of the drilling fluid the detents 70 on the collet fingers 65 hold the ball valve operator 35 at the lower end position illustrated in FIGS. 2A and 2B at which the ball valve 32 is fully opened. The drilling fluids pass downwardly through the open ball valve, the drill collars, and the drill bit into the bore hole in the normal manner.

While drilling, as the bore hole is drilled deeper, each time that the bore hole deepens the length of a section of drill pipe, it is necessary to add an additional section of pipe at the surface. In order to add the section it is required that the surface connections with the drill string including the kelly be disconnected from the uppermost pipe section to permit introducing a new pipe section at the surface end of the string. During this time it will be apparent that the upper end of the drill string is open and the drilling fluid within the drill string and bore hole around the drill string must be of sufficient weight to overcome any formation pressure being exerted into the bore hole. Also at times when it is necessary to change drill bits the drill string must be pulled from the bore hole and run back into the bore hole thereby requiring the sequential disconnection and connection of the sections of drill pipe which leaves the upper end of the drill string open during times when these procedures are being performed.

If, at any time during the running of the drill string into the bore hole, during normal drilling, when adding sections of drill pipe to the drill string, and when pulling the drill string from the bore hole a sudden pressure surge occurs causing the well to "kick", the spring loaded flapper valve 40 immediately swings up to the closed position as shown in FIG. 2A. At the time of this initial pressure surge the flapper valve closes while at that instant the ball valve 32 is still in the full open position of FIG. 2B. With the flapper valve closed some flow may occur upwardly through the bypass ports 66 though the port is sufficiently small that a pressure drop across the flapper valve is induced by the pressure surge which applies an upward force to the ball valve operator 35. The detents 70 are cammed inwardly from the lower locking recess 72 in the tool body section 22, see FIG. 2A, releasing the ball valve operator to move upwardly. The operator is lifted pulling the operator arms 41 upwardly because of the flanged coupling between the lower end of the operator 35 and the heads 84 on the operator arms. The upward movement of the ball valve operator arms pulls the operator pins upwardly. The inward ends of the pins 85 are in the operator recesses 101 along the opposite flat faces of the ball valve. The upward movement of the pins 85 in the operator recesses forces the ball valve to rotate on the mounting pins 103 which engage the mounting recesses 102 along the flat side faces of the ball valve. The valve operator 35 moves upwardly until the stop shoulder 53 around the upper end portion of the valve operator at the fishing neck engages the internal stop shoulder 54 within the valve body section 21. At this upper end position of the valve operator the ball valve is rotated 90° to the fully closed position illustrated in FIG. 6 at which the ball valve prevents any upward flow through the safety and kill valve. The difference between the line of sealing of the lower seat surface 110 with the ball valve and the line of sealing of the ring seals 111 with the inner wall of the body section 23 provides a downwardly facing annular area over the lower ball valve seat urging the ball valve along with the force of the spring 115 upwardly against the solid lower face of the ball valve as evident in FIG. 6. At this upper end position of the ball valve operator 35 the detents 70 on the collet fingers 65 spring outwardly into the upper locking recess 71 within the valve body section 22 releasably locking the ball valve operator at the upper end position holding the ball valve 32 closed. With the ball valve fully closed the spring 62 returns the flapper valve 40 upwardly also to the fully closed position as seen in FIG. 6. The safety and kill valve 10 will remain closed until mechanically reopened though heavier drilling mud can be pumped downwardly through the valve to "kill" the well.

Figure 7:
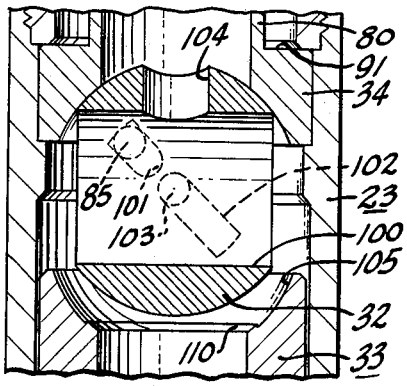
FIG. 7 is a fragmentary longitudinal view in section showing the ball closed and the lower seat moved downwardly permitting downward flow through and around the ball valve.

In order to "kill" the well, the heavier drilling fluid is pumped from the surface downwardly in the drill string 11. The downward flow of drilling fluid acting against the flapper valve 40 forces the valve downwardly against the spring 62 opening the valve to a position which may range for example from that shown in FIG. 5 to a fully opened position in which the flapper valve swings into the side window 55. The downward flow of the drilling fluid moves through the bore 31 of the valve 10 into the bypass port 104 in the upper side of the ball valve 32 which is in the position illustrated in FIG. 6. The drilling fluid passes into the bore 100 of the ball valve and laterally outwardly through the opposite ends of the ball valve into the space within the tool body section 23 around the ball valve between the lower and upper ball valve seats 33 and 34. The pressure of the drilling fluid being pumped downwardly acting over the annular area of the lower valve seat 33 measured between the line of sealing of the seat surface 110 with the ball valve and the line of sealing of the ring seals 111 with the bore of the body section forces the lower ball valve seat 33 downwardly away from the ball valve to a position such as illustrated in FIG. 7 so that the drilling fluid may flow downwardly around the ball valve between the lower face of the ball valve and the lower seat surfaces 105 and 110 on the upper end of the lower seat 33. The drilling fluid flows into the bore of the lower seat 33 below the ball valve and downwardly continuing through the drill collars 130 to the drill bit and outwardly through the ports 15 in the drill bit to the formation to apply a greater hydrostatic pressure on the formation for "killing" the well to contain the excessive formation pressure. It will be apparent that after the lower seat 33 moves downwardly there will be a tendency for pressure equalization across the seat allowing the spring 115 to move the seat back upwardly. A throttling effect will thus occur with the lower seat moving downwardly and back upwardly repeatedly as the drilling fluid is pumped downwardly through the closed safety and kill valve. If the pumping rate of the downwardly flowing drilling fluid is sufficiently high, the lower seat 33 will remain at the downwardly spaced position allowing the drilling fluid to flow to the drill bits and onto the well formation. Once sufficient drilling fluid has been pumped to the formation to provide enough hydrostatic pressure to "kill" the well, a condition of equilibrium will be reached equalizing the pressure across the lower seat 33 so that the lower seat is then raised by the spring 115 back into contact with the lower face of the closed ball valve 32 so that the kill and safety valve 10 is again fully closed maintaining the well shut-in. The valve will remain closed until such time as it is either mechanically or hydraulically opened by one of the following procedures. The valve may be mechanically reopened by lowering a suitable fishing tool on a wireline engaging the fishing neck 42 at the upper end of the ball valve operator 35. The fishing tool is then used to apply downward force on the ball valve operator camming the detents 70 inwardly from the upper locking recess 71 releasing the operator 35 to move downwardly. The operator is then forced downwardly carrying the ball valve operator arms 41 downwardly rotating the ball 32 to the open position of FIG. 2B. It will be apparent that when the operator arms move downwardly the pins 85 on the inner faces of the arms move from the positions of FIG. 6 to the positions of FIG. 2B to rotate the ball valve on the pins 103 90° back to the open position. The safety and kill valve may similarly be reopened hydraulically by dropping a suitable ball member down the drill string to the seat surface 44 at the lower end of the fishing neck on the ball valve operator 34. An increase in the pressure within the drilling fluid in the drill string above the valve 10 develops a pressure differential across the ball member at the upper end of the ball valve operator forcing the valve operator downwardly from the upper end to the lower end position as described in the mechanical closing of the valve so that the ball valve 32 is rotated open. The downward movement of the ball valve operator 35 and the arms 41 is limited by the engagement of the lower end surfaces 90 on the heads of the operator arms with the top surface 91 on the ball valve upper seat 34. At this lower end position the detents 70 snap back outwardly into the lower locking recess 72 relocking the safety and kill valve open.

If the safety and kill valve is hydraulically reopened using the ball member, it will be obvious that before drilling with normal drilling fluid flow can be resumed it will be necessary to retrieve the ball member so that drilling fluid may be pumped downwardly through the valve. This can be achieved in at least two ways. If there is sufficient formation pressure and conditions will permit allowing the well formation to displace drilling fluids upwardly the ball could be lifted back to the surface. Alternatively, drilling fluid can be pumped down the annulus in the well bore around the drill string and back upwardly through the drill bit the valve 10 and the drill string to the surface. While the flapper valve 40 would be closed the bypass port 66 in the flapper valve will allow sufficient upward flow of the drilling fluid to permit the ball element to be retrieved from the drill string.

It will be evident that a new and improved drill string safety and kill valve has been described and illustrated. The valve has numerous functional and structural advantages over the prior art valves employed for similar purposes.

What is claimed is:

1. A valve for a flow conductor comprising: a valve body connectible in said flow conductor to form an integral flow section thereof; a first valve assembly in said body having means to shut off flow through said body in a first direction when operating in a closed mode, and means to permit flow through said body in a second opposite direction when operating in, said closed mode first valve assembly permitting flow in either direction when operating in an open mode, a second valve assembly in said body having restriction means adapted to permit limited flow through said body in said first direction when said first valve assembly is in said open mode, and full flow through said body in said second direction when said first valve assembly is in said open mode; and valve operator means between said first and said second valve assemblies to close said first valve assembly responsive to closure of said second valve assembly when said second valve assembly is biased toward to said first direction in response to flow in said first direction through said body above said limited flow.

2. A valve in accordance with claim 1 wherein said first valve assembly includes a ball valve member.

3. A valve in accordance with claim 1 wherein said second valve assembly includes a flapper valve member.

4. A valve in accordance with claim 1 wherein said first valve assembly includes a ball valve member and said second valve assembly includes a flapper valve member.

5. A valve in accordance with claim 1 wherein said first valve assembly includes a ball valve member, first and second ball valve seats on opposite sides of said ball valve member, and one of said seats is adapted to move away from said ball valve member to allow bypass around said ball valve member when closed responsive to fluid flow through said body in said second direction.

6. A valve assembly in accordance with claim 5 wherein said second valve assembly includes a flapper valve member and said valve operator means is operatively connected with said ball valve member of said first valve assembly to close said ball valve member responsive to said flow in said first direction through said second valve assembly.

7. A valve in accordance with claim 1 wherein said second valve assembly includes a flapper valve member and a valve operator supporting said flapper valve connected with said first valve assembly to close said first valve assembly responsive to flow in said first direction through said second valve assembly.

8. A valve in accordance with claim 7 wherein said flapper valve member has a bypass port therethrough.

9. A drill string safety and kill valve comprising: a valve body connectible into said drill string to form an integral flow section thereof; a ball valve assembly in said body having a ball valve member rotatable between open and closed positions for shutting off the flow in a first direction when in said closed position and having means to permit flow past said ball valve member in a second opposite direction when in said closed position, said ball valve assembly permitting flow in either direction when in said open position; and a flapper valve assembly in said body including means operatively coupling said flapper valve assembly with said ball valve assembly, said flapper valve assembly including a flapper valve member having a bypass port therethrough and mounted to close responsive to flow in said first direction and to operate said ball valve assembly to close said ball valve member when flow through said port is above a predetermined flow rate and to open responsive to flow in said second opposite direction.

10. A valve in accordance with claim 9 wherein said ball valve assembly includes first and second seat members on opposite sides of said ball valve member, one of said seat members on the opposite side of said ball valve member from said flapper valve assembly being longitudinally movable away from said ball valve member to permit bypass fluid flow around said ball valve member into said seat member responsive to fluid flow in said body in said second opposite direction.

11. A valve in accordance with claim 10 including a tubular ball valve operator assembly coupled with said ball valve member and supporting said flapper valve assembly for rotating said ball valve member responsive to a pressure differential across said flapper valve member when said valve member is closed.

12. A valve in accordance with claim 11 wherein said ball valve operator assembly includes ball valve operator arms connected with said ball valve member along opposite sides of said member to rotate said member between said open and closed positions.

13. A valve in accordance with claim 12 including detent means on said ball valve operator for releasably locking said operator at a first position at which said ball valve member is opened and a second position at which said ball valve member is closed.

14. A valve in accordance with claim 13 wherein said ball valve member has a central bore aligned with the axis of said valve body to permit flow through said member at said open position of said member and aligned substantially perpendicular with said valve body axis at said closed position of said valve member and said ball valve member has a bypass port in a side of said ball valve member opening into said bore through said ball valve member and positioned on the side of said ball valve member opposite said ball valve member seat movable away from said member to allow bypass around said ball valve member.

15. A drill string safety and kill valve comprising: a tubular valve body adapted to be connected in said drill string as an integral part thereof forming flow section of said string; a ball valve having a central bore therethrough and a bypass port in one side thereof opening into said bore; mounting means between said ball valve and said valve body supporting said ball valve for rotation between a first opened position at which said bore is aligned with the longitudinal axis of said valve body and a second position at which said bore extends substantially transverse to the longitudinal axis of said valve body and said bypass port is in the upper side of said ball valve while the side of said ball valve opposite said bypass port shuts off flow through said valve body in a first direction toward said bypass port; a first lower tubular ball valve seat movably secured in said valve body below said ball valve and having a seat surface engageable with said ball valve for forming a fluid tight seal with said ball valve; a spring between said lower ball valve seat and said valve body biasing said lower ball valve seat toward said ball valve; an upper ball valve seat secured in said ball valve body against said ball valve on the opposite side of said ball valve from said lower ball valve seat; a tubular ball valve operator mounted for longitudinal movement within said valve body above said ball valve; ball valve operator arms connected between said ball valve and said ball valve operator for rotating said ball valve between said first opened and said second closed positions responsive to longitudinal movement of said ball valve operator; a flapper valve pivotally supported in said ball valve operator for movement between a first closed position across the bore of said operator to a second open position; a spring engaged between said flapper valve and said ball valve operator biasing said flapper valve toward said first closed position; means providing a bypass port through said flapper valve; and detent means on said ball valve operator for releasably locking said ball valve operator at a first position at which said ball valve is open and a second position at which said ball valve is closed.

16. A valve in accordance with claim 15 wherein said ball valve operator has a fishing neck for engagement of an operating tool to mechanically reopen said ball valve.

17. A valve in accordance with claim 16 wherein said detent means includes a plurality of circumferentially spaced collet fingers in said ball valve operator each of said collet fingers having an external detent member engageable in locking recesses in said valve body.

* * * * *